United States Patent [19]

Geschka et al.

[11] 4,348,877

[45] Sep. 14, 1982

[54] AUTOMATIC TOWEL DISPENSER

[75] Inventors: Hugo W. Geschka, Düsseldorf; Bernd Beitecke, Dortmund, both of Fed. Rep. of Germany

[73] Assignee: Luk Lamellen und Kupplungsbau GmbH, Bühl, Fed. Rep. of Germany

[21] Appl. No.: 237,943

[22] Filed: Feb. 25, 1981

Related U.S. Application Data

[63] Continuation of Ser. No. 50,642, Jun. 21, 1979, abandoned.

[30] Foreign Application Priority Data

Jun. 21, 1978 [DE] Fed. Rep. of Germany ..... 2827183

[51] Int. Cl.[3] ..... A47K 10/30

[52] U.S. Cl. ..... 68/13 R

[58] Field of Search ..... 68/9, 13 R, 38, 175, 68/22 R; 312/38; 38/2; 221/27-29; 15/40

[56] References Cited

U.S. PATENT DOCUMENTS

| | | | |
|---|---|---|---|
| 2,295,955 | 9/1942 | La Page | 68/13 R X |
| 3,083,481 | 4/1963 | Kamen | 68/13 R X |
| 3,112,631 | 12/1963 | Gordon | 68/13 R X |
| 3,848,438 | 11/1974 | Tachibana et al. | 68/22 R |

FOREIGN PATENT DOCUMENTS

| | | | |
|---|---|---|---|
| 2602278 | 7/1977 | Fed. Rep. of Germany | 68/13 R |

*Primary Examiner*—Philip R. Coe

*Attorney, Agent, or Firm*—Kontler, Grimes & Battersby

[57] ABSTRACT

An automatic towel dispenser whose housing contains a washing and a drying chamber for an endless towel which can pass therethrough and has a cleaned section available for use and extending from the housing between a delivery slot and an inlet slot of the housing. The towel is movable from the inlet slot to the washing chamber and from the drying chamber to the delivery slot, and the housing also contains a first supply chamber for variably stacking a plurality of soiled towel sections and a second supply chamber for variably stacking a plurality of cleaned towel sections. The washing chamber has at least one wash and at least one rinsing tub through which the towel can pass in the form of loops. The dispenser is further provided with a water feed valve and a water discharge valve connected to the washing chamber. The water feed valve is actuatable at the start of a washing cycle and the water discharge valve is actuatable on completion of the washing cycle. Still further, the dispenser is provided with means for flooding the wash tub and the towel therein, the flooding means being actuatable upon completion of a washing cycle.

8 Claims, 1 Drawing Figure

AUTOMATIC TOWEL DISPENSER

Figure 1:
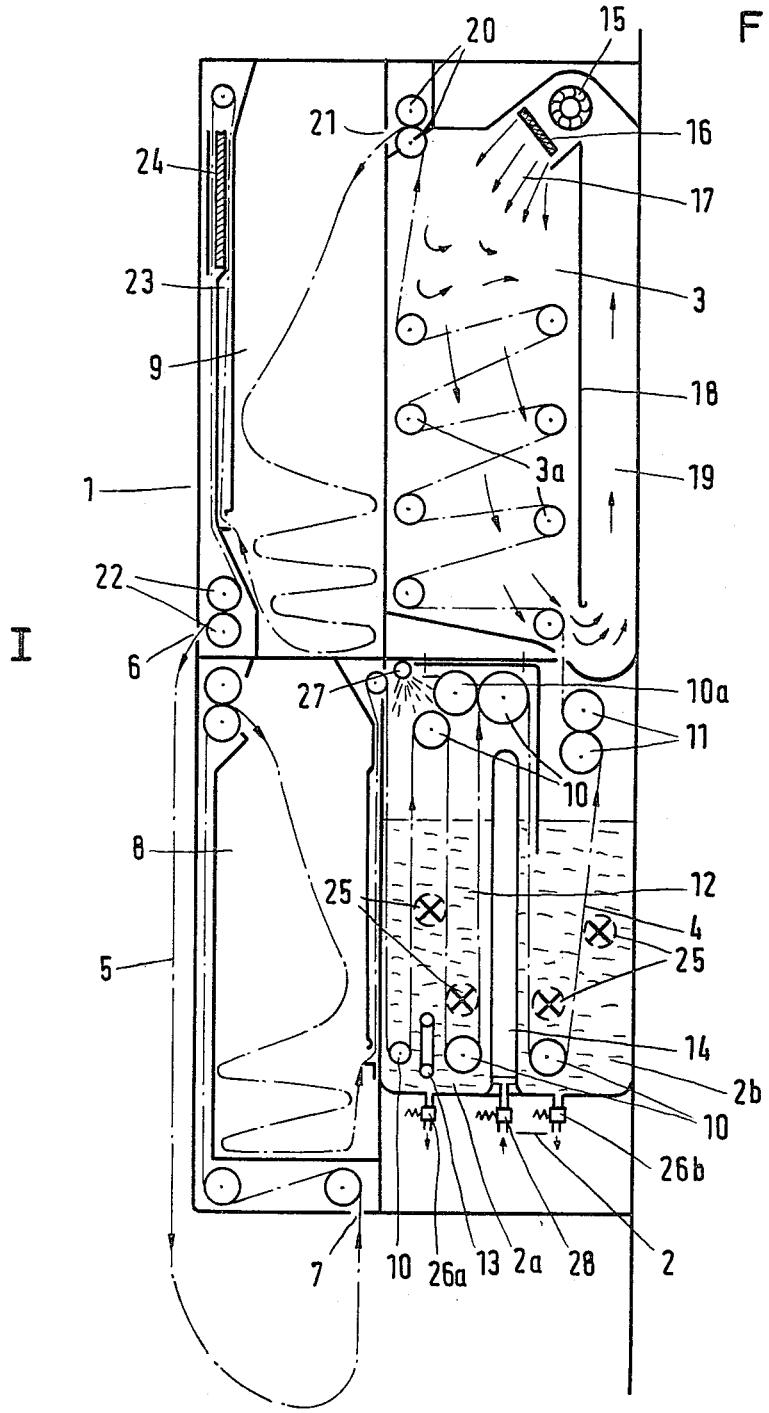

This is a continuation of application Ser. No. 50,642, filed June 21, 1979, now abandoned.

The invention relates to an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being movable through the washing and drying chambers, while washing and drying processes are set into operation, and being depositable in the second supply chamber for cleaned towel sections, the washing chamber having at least one wash tub and one rinsing tub through which the endless towel can pass in the form of loops, and including a water feed valve and a water discharge valve connected to the washing chamber, the water feed valve being actuatable at the beginning of a washing cycle, and the water discharge valve at the end of the cycle by switching or control members.

Such a device is disclosed in U.S. Pat. No. 2,295,955. In that device, however, especially during very long intervals between individual washing and drying processes, residues of the washing medium or agent, such as soap or the like, are deposited in the wash tub and on the towel or on the walls, the drain pipe and the drain valve, and become encrusted there. In the case of the towel, this can cause discoloration and difficulties in dissolving these residues in the subsequent washing process. In the wash tub per se and in the drain and the valves, this can cause interference with smooth functioning such as clogging of the drain especially. Furthermore, bacteria and mold can form.

It is accordingly an object of the invention to provide and automatic towel dispenser as well as a method of operating the same which avoids the disadvantages of heretofore known devices of this general type wherein deposits of washing medium or agent occur.

With the foregoing and other objects in view, there is provided, in accordance with the invention, in an automatic towel dispenser having a housing containing a washing and a drying chamber for an endless towel movable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being movable through the washing and drying chambers, while washing and drying processes are set into operation, and being depositable in the second supply chamber for cleaned towel sections, the washing chamber having at least one wash tub and one rinsing tub through which the endless towel can pass the form of loops, and including a water feed valve and a water discharge valve connected to the washing chamber, the water feed valve being actuatable at the beginning of a washing cycle, and the water discharge valve at the end thereof, an improvement therein which comprises means for flooding the wash tub and the towel disposed therein, the flooding means being actuatable upon completion of a washing cycle.

In accordance with another feature of the invention, the flooding means comprise at least one spray device, by which the walls of the washing chamber and the towel are sprayed with water after the washing cycle has been completed.

In accordance with a further aspect of the invention, there is provided a method of operating the automatic towel dispenser which comprises flooding the wash tub and the towel therein upon completion of a washing cycle by at least once filling the wash tub with flooding medium and subsequently emptying the wash tub.

In accordance with a further feature of the invention, the method comprises moving the towel, even if only slightly, during the flooding of the wash tub and the towel therein.

In accordance with an additional feature of the invention, the method comprises moving the towel in direction of passage thereof through the automatic towel dispenser.

In accordance with an modification, the method comprises moving the towel cyclically back and forth.

In accordance with yet another feature of the invention, the automatic towel dispenser comprises means for mechanically cleaning the washing chamber disposed in the washing chamber, the flooding means and the cleaning means being effective simultaneously.

In accordance with a further feature of the invention, the method comprises actuating mechanical cleaning means, such as brushes, cylinders or rollers or the like in the washing tub during the flooding of the tub and the towel.

Other features which are considered as characteristic of the invention are set forth in the appended claims.

The invention is not intended to be limited to the details shown, since various modifications and structural changes may be made therein without departing from the spirit of the invention and from the scope and range of equivalence of the claims.

The single FIGURE of the drawing is a diagrammatic view of the automatic towel dispenser according to the invention.

Referring now to the FIGURE of the drawing, there is shown therein the automatic towel dispenser I according to the invention having a housing 1 with a washing chamber 2 and a drying chamber 3 provided therein. An endless towel 4, that is to be passed through the chambers 2 and 3, has cleaned towel sections 5 thereof, which are either ready or to be made ready for use, that extend between a delivery slot 6 and an inlet slot 7 on the outside of the housing 1. Between the inlet slot 7 and the washing chamber 2, as viewed in the direction of travel of the towel 4 represented by the various arrows shown thereon, a supply chamber 8 for the variable or alternating stacking of several used towel sections is provided. Between the drying chamber 3 and the delivery slot 6, a supply chamber 9 for the variable or alternating stacking of several clean towel sections is also provided. After the supply chamber 9 is sufficiently empty or the supply chamber 8 is sufficiently full, the towel dispenser is set into operation and a suitable number of soiled towel sections from the supply chamber 8 is initially passed through the washing and drying chambers 2 and 3 and then deposited in the supply chamber 9 for clean toweling.

The washing chamber 2 is made up of a wash tub 2*a* and a rinsing tub 2*b*, through which the towel 4 is conveyed in the form of at least approximately vertical loops and over deflection rollers 10. At the outlet from the wash tub 2*a*, squeezing cylinders 10*a* are provided, and at the outlet from the rinsing tub 2*b*, squeezing cylinders 11. Heating rods 13 or the like are provided for heating the washing solution 12 in the wash tub 2*a*. A partition 14 is disposed between the wash and rinsing tubs 2*a* 2*b*, respectively.

After passing the squeezing cylinders 11, the towel 4 arrives in the drying chamber 3, wherein it is guided in the form of loops over deflection or reversing rollers 3*a*. A blower 15 with a heater 16 is provided in an upper region of the drying chamber 3, and blows drying air in the direction of the arrows 17 onto the towel 4. Through an intake or induction shaft 19 separated by a partition 18 from the drying chamber 3, the drying air is sucked upwardly from below to the blower 15 and is there blown out again into the drying chamber 3. The drying air is thus circulated countercurrent to the travel of the towel 4. A pair of transport rollers 20 advances the dried towel 4 through an inlet slot 21 into the supply chamber 9, depositing the towel 4 therein in the form of loops. If fresh toweling is required, either, by pressing a suitable actuation switch, a pair of rollers 22 is set in motion for a given amount of rotation or by manually pulling down the towel section 5, fresh toweling is drawn out through the slot 6, whereby the fresh toweling located in the supply chamber 9 is taken from the lower layers thereof amd drawn upwardly through an unfolding shaft 23 and, if desired or necessary, past an ironing device 24 and further on to the rollers 22 and out through the slot 6.

Both in the wash as well as in the rinsing tub 2*a* and 2*b*, respectively, vane wheels 25 are provided on both sides of the towel 4 below the liquid level and are rotatable at high speed and thereby stir up the washing solution 12 as well as the rinsing liquid and set the liquid and the towel 4 in motion, relative motion between the washing liquid 12 and rinsing liquid, respectively, and the towel 4 being producible thereby, which assures intensive cleaning of the towel 4 while simultaneously preserving it.

After the washing and drying process is ended, the washing solution 12 is drained out of the wash tub 2*a* through a drain valve 26*a* and, advantageously, also the rinsing liquid from the rinsing tub 2*b* through a drain valve 26*b*.

In order to remove any remaining adherent washing medium, a spraying device 27 can then be set into operation or/and a water feed valve 28 can be opened so that fresh water can run into the wash tub 2*a* at least. The rinsing tub 2*b* can also be filled with water while the valve 26*a* or also the valve 26*b* remains closed. The flooding of at least the wash tub 2*a* accomplished thereby causes those washing medium residues, which would otherwise be deposited on the towel 4 or the wash tub 2*a* and possibly also on the rinsing tub 2*b* and the drain lines and the valves, to be flushed away. It may also be advantageous if, during the flooding, motion of the transport and the squeezing cylinders occurs so that there is also a mechanical movement which promotes washing-out of the washing medium or agent. It may further be of advantage if the vane wheels 25 are additionally actuatable during the flooding.

We claim:

1. In an automatic towel dispenser with a housing having a delivery slot and an inlet slot and containing washing and drying chambers for an endless towel which is movable therethrough and has a cleaned section available for use and extending from the housing between the delivery and inlet slots, means defining a path for travel of the towel from the inlet slot to the washing chamber and from the drying chamber to the delivery slot, a first supply chamber provided in the housing and arranged to variably store a plurality of looped soiled towel sections between the inlet slot and the washing chamber, as viewed in the direction of movement of the towel, a second supply chamber provided in the housing and arranged to variably store a plurality of looped cleaned towel sections between the drying chamber and the delivery slot, as viewed in said direction, the path of movement of the towel including a portion along which the soiled towel sections advance through the washing and drying chambers to be respectively washed and dried, at least one wash tub and at least one rinsing tub in the washing chamber, means for advancing the towel through the tubs in the form or loops, water feed and water discharge valves connected to the washing chamber, and means for respectively operating the water feed and water discharge valves at the start and on completion of a washing cycle, the improvement which consists in the provision of a device for flushing residues out of the washing chamber including means for flooding the wash tub and the towel disposed therein, means for draining liquid from the wash tub, and means for first actuating said flooding means and for thereupon actuating said draining means during intervals between successive washing cycles.

2. The improvement of claim 1, wherein said flooding means comprises at least one spray device.

3. The improvement of claim 1, wherein said actuating means comprises means for flooding the wash tub and the towel therein at least once upon termination of a washing cycle by filling the wash tub with a flooding medium and by subsequently emptying the wash tub.

4. The improvement of claim 1, further comprising means for moving the towel during flooding of the wash tub.

5. The improvement of claim 1, further comprising means for advancing the towel in said direction during flooding of the wash tub.

6. The improvement of claim 1, further comprising means for moving the towel cyclically back and fourth during flooding of the wash tub.

7. The improvement of claim 1, further comprising means for mechanically cleaning the towel section in the washing chamber and means for actuating said cleaning means simultaneously with actuation of said flooding means.

8. The improvement of claim 1, further comprising mechanical cleaning means in the wash tub and means for actuating said cleaning means during flooding of the wash tub.

* * * * *